United States Patent [19]

Cable

[11] Patent Number: 4,896,887

[45] Date of Patent: Jan. 30, 1990

[54] GOLFING AID

[76] Inventor: Alan R. Cable, 16 Widecombe Road, Mottingham, London SE9, United Kingdom

[21] Appl. No.: 287,112

[22] Filed: Dec. 21, 1988

[51] Int. Cl.[4] ..... A63B 69/36

[52] U.S. Cl. ..... 273/189 R

[58] Field of Search ..... 273/183 B, 188 R, 189 R, 273/189 A, 190 R

[56] References Cited

U.S. PATENT DOCUMENTS 3,036,831 5/1962 Engan ..... 273/189 A
3,324,851 6/1967 Posner ..... 273/189 R
3,415,524 12/1968 Vickers ..... 273/189 R
3,672,682 6/1972 Yanagidaira ..... 273/189 R
4,239,228 12/1980 Norman et al. ..... 273/189 R

FOREIGN PATENT DOCUMENTS 281171 12/1927 United Kingdom ..... 273/189 R

*Primary Examiner*—George J. Marlo
*Attorney, Agent, or Firm*—Nixon & Vanderhye

[57] ABSTRACT

A golfing aid comprises a yoke and with arm restraints attached to it on opposite sides and spaced apart. Straps enable the aid to be fastened to the golfer's arms above the elbows with the yoke passing behind the leading arm and in front of the trailing arm, thus enabling the golfer to develop a good swing technique.

10 Claims, 3 Drawing Sheets

GOLFING AID

The present invention relates to a golfing aid, in particular to an aid for improving swing technique by assisting the golfer to achieve correct fundamental address positioning.

Stance is important in achieving a good swing technique. Incorrect positioning of the arms or hands, misalignment of feet, shoulders and head may all lead to difficulties.

The aim of the present invention is to provide a device which will assist the golfer in achieving a proper, technically-sound, fundamental address position.

The present invention provides a golfing aid comprising an elongate rigid yoke and two means for attaching the yoke to the user's arms, the attachment means being spaced apart on, and carried by, the yoke, the attachment means being so positioned relative to a longitudinal axis of the yoke, that when the aid is attached to the user's arms, the arms are positioned at different positions relative to the longitudinal axis so that one arm is further from the user's body that the other. In one preferred form of the invention the attachment means are positioned on opposite sides of the longitudinal axis of the yoke whereby when the aid is worn, one arm passes to one side of the yoke and the other arm passes to the other side of the yoke. In this way the aid can be worn so as to cause the elbow of the leading arm to be held further from the body than the elbow of the trailing arm is naturally bent. This is imperative for a correct golf swing. By holding the arms in this way the aid encourages the user to hold his leading shoulder higher than his trailing shoulder: another feature of a good golfing posture and one advocated by golfing professionals.

The yoke may be a rod or tube. It may be constructed from any material but light and strong ones such as plastics materials or aluminum alloys are preferred.

The yoke may be straight, or alternatively it may be kinked so that the distance between the back of one arm and the front of the other measured in a direction transverse to the longitudinal axis of the yoke, is less than the thickness of the yoke.

Each attaching means may comprise ties or a strap or straps. The straps may be of natural or synthetic material such as webbing. The ends of the straps may have fastenings, for example, hook and loop materials such as sold under the trademark VELCRO. Alternatively buckles or rings may be used. Each arm attachment means may be mounted on the yoke by, for example, bolts, binding, bonding, rivetting, welding, or by providing a sleeve on straps which passes round the yoke, or by providing openings on the yoke through which straps can pass. Alternatively openings may be provided in the straps through which the yoke may be passed.

The yoke may be constructed so as to provide more than one mounting position for one or both arm attachment means. Where the yoke is a hollow rod or tube, the tube may have a series of slots or holes spaced along its length, through which the arm attachment means may be inserted in different positions. In this way the spacing of the attachment means may be adjusted to suit the physical requirements of different golfers.

Each arm attachment means may be a flexible strap attached between its ends to the yoke, or it may comprise a pair of straps, one end of each strap being anchored to the yoke. Alternatively each arm attachment means may include an arcuate arm support, conveniently of a semi-rigid plastics material, anchored on the yoke in any of the previously mentioned ways. Straps may then be attached to the ends of the supports for tying the yoke to the golfer. By partly encircling the golfer's arms, the support may maintain the golfer's arms at the correct spacing. Adjustment of the spacing of the supports on the yoke may be providing, for example, by providing a screw-threaded shank on one of the supports, which can be passed through any one of a number of holes on the yoke and secured in position with a wing nut.

The present invention is further described by example with reference to the drawings, in which.

Figure 1:
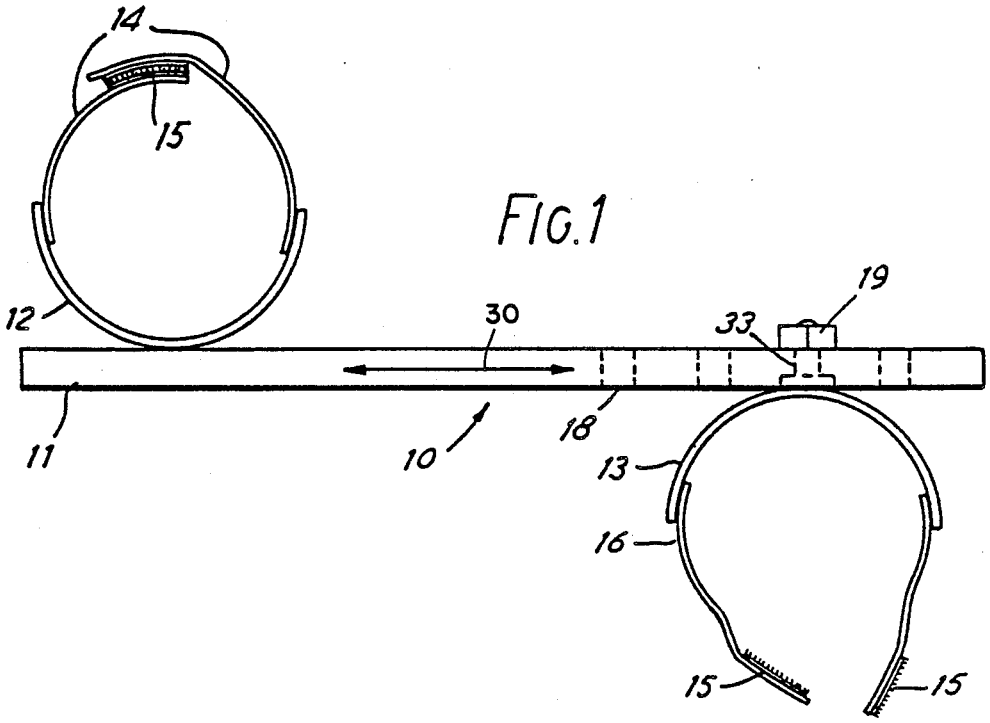
FIG. 1 shows a plan view of a golfing aid according to present invention.

FIG. 1 shows a golfing aid 10 comprising a hollow rod or tube 11 and two arm restraints 12. Each arm resistant is made from a semi-circular strip 13 of semi-rigid plastics material. On each end of each semi-circular strip is attached a webbing strap 14 by rivets (not shown). Each semi-rigid strip is therefore associated with a pair of straps. The two straps can be secured to each other by means of hook and loop fastening material such as is sold under the trademark VELCRO, stitched to the free end of each strap.

One arm restraint is attached to the rod at a distance from one end, the other restraint is attached to the rod on the opposite side of the rod to the first restraint and longitudinally spaced from it and from the other end of the rod. The distance between the arm restraints is chosen to be of a suitable dimension for the intended user.

The second restraint may be rivetted or attached by any method described earlier in respect of the first restraint. The distance between the arm restraints may be fixed. However it is preferred that the distance should be adjustable and in this embodiment the rod is provided with a series of holes 18 through any one of which a screw shank 17 attached to the strip 13 on the second restraint 12 can pass. The arm restraint is held in place on the rod by means of a plastics nut 19 threaded onto the shank 17. The nut is provided with ribs 31 to make it easy to grip. By selecting the appropriate hole 18, the spacing of the arm restraints on the yoke can be adapted to suit the stature of the golfer. When the restraint is fitted in a selected hole a square cross-section portion 32 fits into a square cross-section counterbore 33 to prevent the restraint rotating about the axis of the shank.

Figure 2:
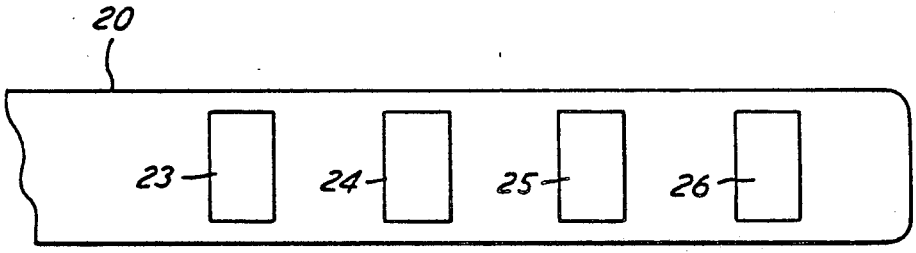
FIG. 2 shows a front view of part of another golfing aid, on an enlarged scale, in accordance with the invention.
Figure 3:
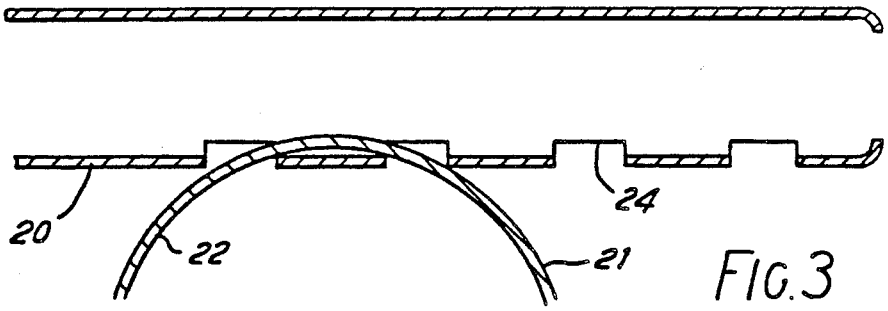
FIG. 3 shows a cross section on the line III—III of the aid of FIG. 2 with an arm strap in position.

FIGS. 2 and 3 show a second embodiment. This aid has a tube 20 and two arm restraints 21. Each of the arm restraints is a strap made of webbing material 22. Fastening patches (not shown) of hook and loop material, such as is sold as VELCRO, are sewn on each end of the straps.

One arm restraint (not shown) is attached near one end of the tube by any previously-mentioned method. Its position is fixed. The other end of the tube is provided with a series of longitudinally-spaced holes 23, 24, 25, 26 on the opposite side of the tube from the first restraint. The second arm restraint is secured tot he tube by weaving it in and out of any two holes as shown in FIG. 3. Thus this embodiment can provide spacings between arm restraints and can therefore be adjusted and used by people of different sizes.

Figure 4:
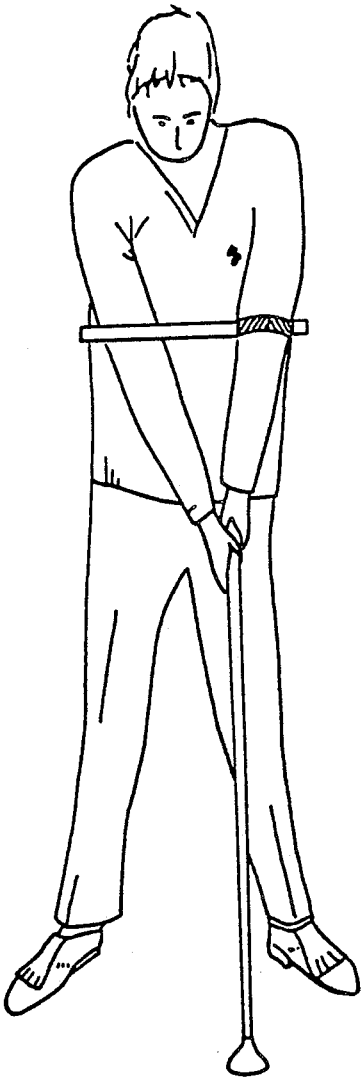
FIG. 4 shows a golfer wearing the aid of FIG. 1.
Figure 5:
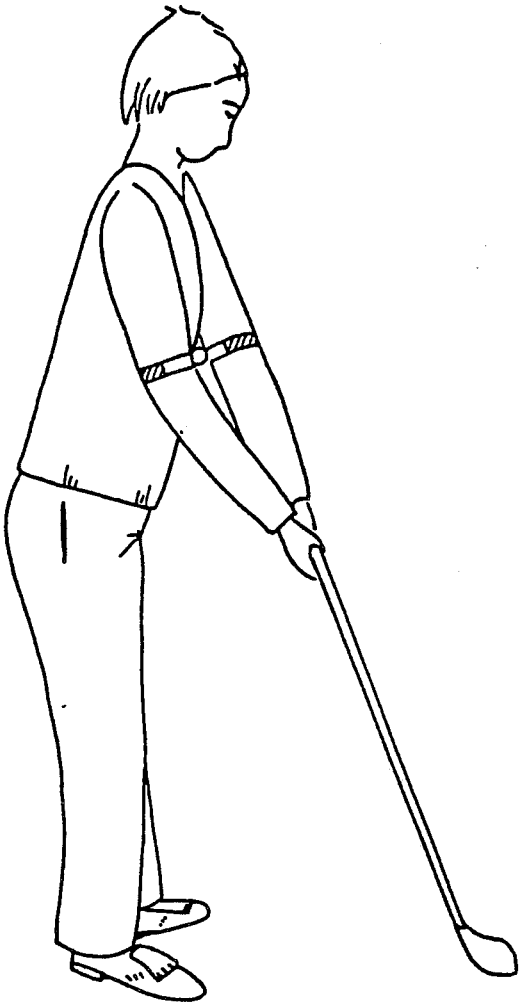
FIG. 5 shows the golfer of FIG. 4 from another direction.

In use, the golfing aid is worn as shown in FIGS. 4 and 5. The aid is held laterally in front of the chest. One end of the tube (11) passes behind the leading arm. This is the left arm for a right handed user. The other end of the tube passes in front of the following arm.

By rotating the tube the arm straps may be positioned so that they can be fastened one around each upper arm of the user immediately above the elbow. If a golfing aid with variable arm restraints is used then the distance between arm restraints is adjusted to fit the stature of the user before being tied to his arms.

For a correct swing position the tube should be aligned parallel to the desired direction of the swing. The arms, and hence shoulders, will then be correctly positioned. An arrow 30 may be printed on the top of the yoke to indicate the line of swing and hence the direction along which the golf ball is intended to travel.

The device is suitable for both right and left-handed players. All that is necessary for a left-handed player is to turn the device over so that the arm restraint that is on the right, as viewed by the user is on the far side of the yoke from his body.

The device will provide an improvement in the swing technique for both beginners and skilled golf players and may be used for professional tuition.

Figure 6:
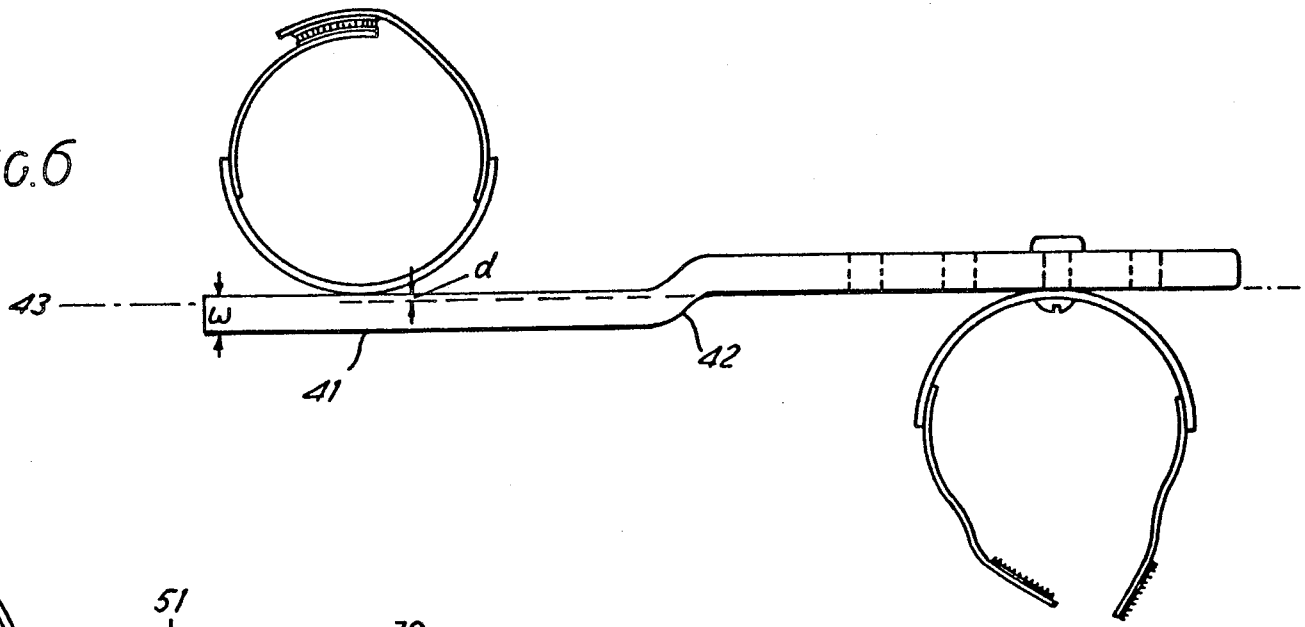
FIG. 6 shows a plan view of modification of the aid of FIG. 1.

FIG. 6 shows a modification of the device of FIG. 1. In this embodiment the yoke 41 is kinked in the middle at 42 so that distance d between the back of the leading arm restraint and the front of the trailing arm restraint, as measured in a direction transverse to the longitudinal axis 43, is less than the width w of the yoke. This enables the spacing between the back of the leading arm and front of the trailing arm, as measured perpendicular to the line of swing to be less than the width of the yoke and possibly even zero, as is preferred by some golfing professionals. In other respects the aid of FIG. 6 may be the same as FIG. 1.

Figure 7:
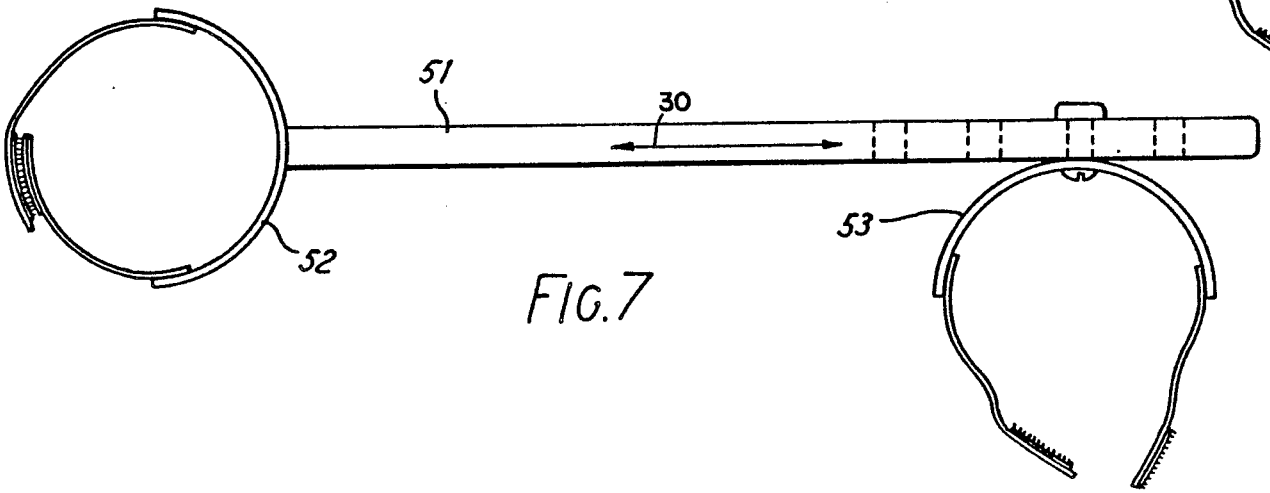
FIG. 7 shows a plan view of another golfing aid in accordance with the invention.

FIG. 7 shows another aid according to the invention. In this embodiment one arm restraint 52 is fixed at the end of the yoke 51, the other restraint 53 being fixed to the side of the yoke as in previous embodiments. When this yoke is worn, the back of the leading arm lies behind the front of the trailing arm, measured in a direction perpendicular to the longitudinal axis of the yoke.

I claim:

1. A golfing aid for attachment to a user's arms comprising: an elongate rigid yoke having a longitudinal axis; and two means for attaching the yoke to the user's arms, said attachment means being spaced apart on and carried by said yoke, the attachment means each having an arm-engaging portion, said arm-engaging portions being positioned at different positions in a direction transverse to said longitudinal axis, whereby when the aid is attached to the user's arms, the arms are positioned at different positions relative to said longitudinal axis so that one arm is further from the user's body than the other.

2. A golfing aid as claimed in claim 1 in which said attachment means are positioned on opposite sides of said longitudinal axis of said yoke whereby when the aid is worn, one arm passes to one side of said yoke and the other arm passes to the other side of said yoke.

3. A golfing aid as claimed in claim 1 wherein the yoke is a rod or tube.

4. A golfing aid as claimed in claim 1, wherein the yoke is straight.

5. A golfing aid as claimed in claim 1, wherein the yoke includes end portions and a kinked portion intermediate said end portions, the arm-engaging means being secured to said end portions, the distance between one arm-engaging portion and the other arm-engaging portion measured in a direction transverse to the longitudinal axis of the yoke being less than the thickness of said yoke.

6. A golfing aid as claimed in claim 1, wherein each attaching means comprises straps.

7. A golfing aid as claimed in claim 1, wherein said yoke includes detachable mounting means for securing one of said attachment means to said yoke at a plurality of portions along the length of said yoke.

8. A golfing aid as claimed in claim 1, in which said yoke comprises a hollow tube, said tube having a series of slots spaced along its length, one of said arm attachment means being inserted selectively in said slots to adjust the spacing of said attachment means in the direction of said longitudinal axis.

9. A golfing aid as claimed in claim 1, wherein said arm attachment means each comprise an arcuate arm support, anchored on said yoke, and straps means attached to the ends of the supports for tying said yoke to the user.

10. A golfing aid as claimed in claim 9, wherein said yoke includes a plurality of holes passing transversely through said yoke and wherein at least one of said supports has a screw-threaded shank which can be passed through any one of said holes and including nut means threadable on said screw-threaded shank for securing said support in position.

* * * * *